US006810696B1

(12) United States Patent
Lonati

(10) Patent No.: US 6,810,696 B1
(45) Date of Patent: Nov. 2, 2004

(54) METHOD FOR TRIMMING LOOSE THREADS ON CIRCULAR KNITTING MACHINES

(76) Inventor: Riccardo Lonati, Via S. Polo, 183, 25134 Brescia (IT)

( * ) Notice: Subject to any disclaimer, the term of this patent is extended or adjusted under 35 U.S.C. 154(b) by 0 days.

(21) Appl. No.: 10/816,869

(22) Filed: Apr. 5, 2004

(30) Foreign Application Priority Data

Apr. 30, 2003 (IT) ..... MI2003A0891

(51) Int. Cl.[7] ..... D04B 15/60
(52) U.S. Cl. ..... 66/134
(58) Field of Search ..... 66/125 R, 133, 66/134, 135, 140 R, 140 S, 145 R, 139

(56) References Cited

U.S. PATENT DOCUMENTS 4,841,748 A * 6/1989 Watanabe et al. ..... 66/140 R
4,967,575 A * 11/1990 Fucik et al. ..... 66/145 R
5,056,339 A * 10/1991 Lonati ..... 66/134
5,070,709 A * 12/1991 Guell ..... 66/140 R
5,144,817 A * 9/1992 Tibbals, Jr. ..... 66/140 R
5,237,841 A * 8/1993 Lonati et al. ..... 66/139
6,000,245 A * 12/1999 Plath et al. ..... 66/139

* cited by examiner

*Primary Examiner*—Danny Worrell
(74) *Attorney, Agent, or Firm*—Guido Modiano; Albert Josif; Daniel O'Byrne

(57) ABSTRACT

A method for trimming loose threads in circular knitting machines, comprising the steps of:

starting from an initial pattern and on the basis of a given type of circular knitting machine, if one wishes to trim the loose threads, measuring a distance between needles of the same color on a same row in order to check whether the distance is at least equal to, or greater than, a minimum distance that allows to perform trimming of the loose threads;

if the distance is shorter than the minimum distance, replacing a portion of the pattern with at least one special color that identifies a different type of knitting process for the portion of pattern, to be performed on the circular knitting machine;

modifying the pattern on the basis of the replacement of the portion of pattern;

producing an advancement by a number of rows equal to the number of drops of the knitting machine that are active; and encoding the pattern with the modifications, in order to perform the knitting process.

5 Claims, 1 Drawing Sheet

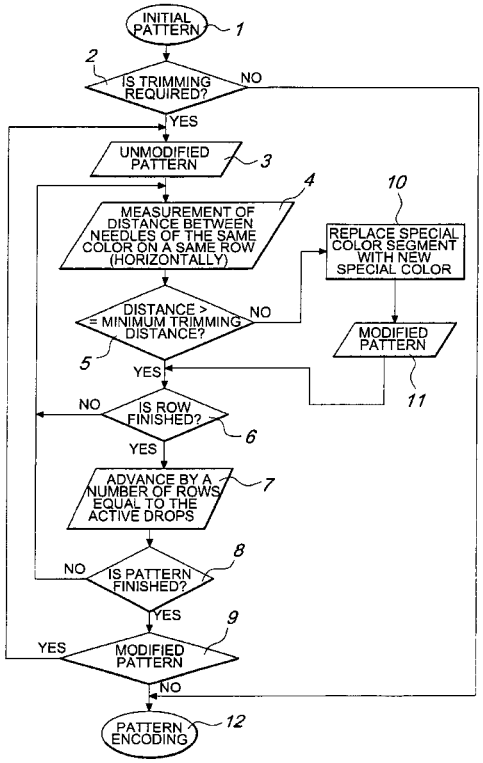

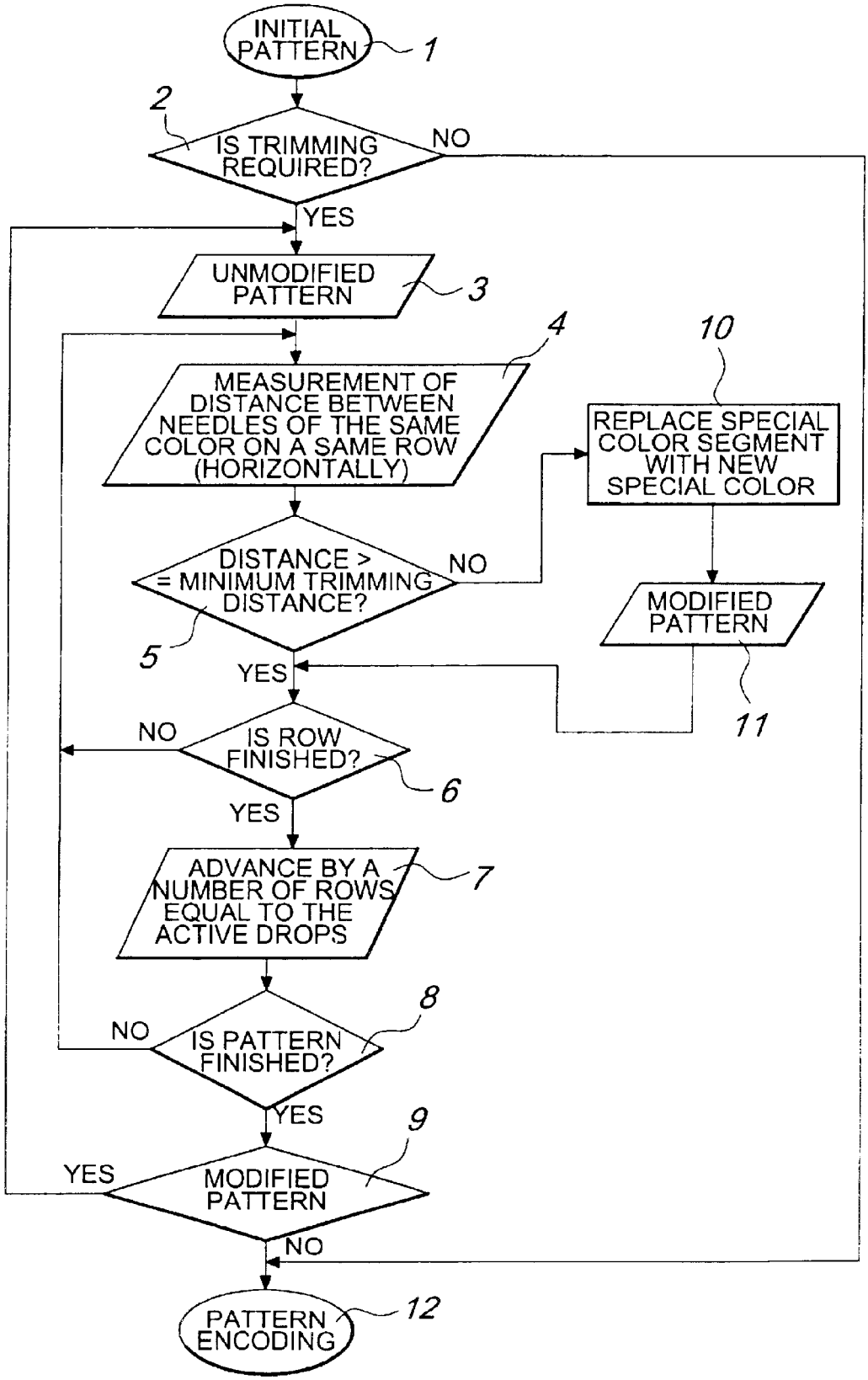
INITIAL PATTERN
1
2
IS TRIMMING REQUIRED?
NO
YES
UNMODIFIED PATTERN
3
4
MEASUREMENT OF DISTANCE BETWEEN NEEDLES OF THE SAME COLOR ON A SAME ROW (HORIZONTALLY)
10
REPLACE SPECIAL COLOR SEGMENT WITH NEW SPECIAL COLOR
DISTANCE > = MINIMUM TRIMMING DISTANCE?
NO
5
MODIFIED PATTERN
11
YES
NO
IS ROW FINISHED?
6
YES
ADVANCE BY A NUMBER OF ROWS EQUAL TO THE ACTIVE DROPS
7
8
NO
IS PATTERN FINISHED?
YES
9
YES
MODIFIED PATTERN
NO
PATTERN ENCODING
12

METHOD FOR TRIMMING LOOSE THREADS ON CIRCULAR KNITTING MACHINES

The present invention relates to a method for trimming loose threads on circular knitting machines. More particularly, the invention relates to a method for trimming loose threads produced by the formation of a particular pattern on a ground or base fabric, so as to avoid leaving loops on the reverse side of the manufactured fabric.

BACKGROUND OF THE INVENTION

As is known, in the field of circular knitting machines, when a particular pattern is produced on a ground fabric, it is necessary to knit in threads that are different from the ground fabric and are carried on the needles by means of specific devices.

In order to achieve a better effect of the knitting process, it is necessary to cut the threads that are knitted in in addition to the ground fabric when such additional knitted-in threads have finished forming stitches. Substantially, in order to avoid leaving any loops on the reverse side of the manufactured fabric, the knitted-in threads added to the ground fabric must be cut or trimmed at the point where the thread has stopped being knitted, i.e., has no longer been knitted in.

Generally, programming of the circular knitting machine starts from a graphic environment that adopts particular conventions based on so-called special colors. Each special color corresponds to a given type of very specific knitting of the machine and produces a predefined link to the physical apparatus that performs the knitting. Knitting is thus performed by the apparatus that produces a particular effect on the fabric.

The meaning of so-called special colors can be modified according to the type of machine and according to the configuration that the user wishes to set on such machine. Such configuration can vary for any type of pattern and for any kind of item.

Generally, a specific special color is associated with the ground fabric and the other special colors are added in order to describe the intended effects and the knitting on the fabric. These effects, as mentioned, are obtained by knitting into the fabric threads that are different from the ground thread and are knitted by means of specific devices, which change when the special color changes.

Therefore, on the basis of these simple machine programming rules, knitting constituted by the so-called ground fabric and by a superimposed "embroidery" is formed, during programming, from a pattern that is provided with only two special colors that are suitable to identify the two different processes: a so-called ground color and a so-called pattern color.

The pattern effect on the fabric is obtained, as mentioned, by knitting in alternative threads in the ground fabric, and in order to obtain a better effect in the knitting process it is possible to cut the threads when they have finished knitting, i.e., they have finished forming stitches. Cutting a thread that ceases its task is also known as trimming.

Trimming can occur, due to production reasons linked to the mechanical structure of the machine, only in certain conditions, one of which allows to trim the thread only when a certain number of needles has passed after the end of its knitting.

Trimming is performed in any case at the point where said thread has ceased knitting.

Currently, if one wishes to perform trimming, in order to eliminate therefore the loose thread, the operator must check that the distance, calculated in terms of the number of needles at the end of the knitting of the thread to be trimmed, is appropriate for trimming on that given type of machine.

Once this check has been performed, the machine operator must change the type of knitting, for example by changing the drop, or by changing the thread guide, so that if the calculated distance is not appropriate for trimming it is still possible to perform said trimming.

These operations obviously entail an expenditure of time and also require the presence of a highly specialized operator.

SUMMARY OF THE INVENTION

The aim of the present invention is to achieve a method for trimming loose threads in circular knitting machines that allows to perform automatically those process corrections that the operator can perform on the machine in order to be able to perform the intended trimming of the loose threads.

Within this aim, an object of the present invention is to provide a method for trimming loose threads in circular knitting machines that allows the operator to be sure that if trimming of the loose threads is possible, it is actually performed with an automatic modification of the knitting process that must be imparted to the circular knitting machine.

Another object of the present invention is to provide a method for trimming loose threads that allows to perform an automatic check of the possibility to trim the loose threads.

Another object of the present invention is to provide a method for trimming loose threads in circular knitting machines that is highly reliable, relatively simple to provide and at competitive costs.

This aim and these and other objects that will become better apparent hereinafter are achieved by a method for trimming loose threads in circular knitting machines, characterized in that it comprises the steps of:

- starting from an initial pattern and on the basis of a given type of circular knitting machine, if one wishes to trim the loose threads, measuring a distance between the needles of the same color on a same row in order to check whether said distance is at least equal to, or greater than, a minimum distance that allows to perform trimming of the loose threads;
- if said distance is shorter than said minimum distance, replacing a portion of said pattern with at least one special color that identifies a different type of knitting process for said portion of said pattern, to be performed on said circular knitting machine;
- modifying said pattern on the basis of said replacement of said portion of said pattern;
- producing an advancement by a number of rows equal to the number of drops of the knitting machine that are active; and
- encoding the pattern with the modifications, in order to perform the knitting process.

BRIEF DESCRIPTION OF THE DRAWING

Further characteristics and advantages of the invention will become better apparent from the description of a preferred but not exclusive embodiment of the method according to the present invention, illustrated by way of non-limiting example in the accompanying drawings, wherein the only FIGURE is a flowchart of the method according to the present invention.

DESCRIPTION OF THE PREFERRED EMBODIMENTS

With reference to the flowchart, the method according to the present invention provides for the following steps.

First of all, starting from an initial pattern, which must be provided on the ground fabric, and on the basis of the number of drops of the, machine that are designed to knit, step 1, a step 2 follows which asks whether one wishes to trim the loose threads or not.

If the answer is negative, the method proceeds directly to the final step 12 for encoding the programmed pattern and for then imparting to the knitting machine commands for the actual production of the fabric with the encoded pattern.

Otherwise, i.e., if trimming of the loose threads is required, control moves to step 3, in which the initial pattern is not yet modified; this is followed by a step 4, in which the horizontal distance between needles of the same color, i.e., needles that knit in the same kind of thread on the same row, is measured.

In step 5, a check is performed in order to determine whether the measured distance is greater than, or equal to, the minimum distance that allows to perform trimming of the loose threads.

If such distance is actually greater than the minimum distance allowed to perform trimming, this is followed by a step 6 which checks whether the row of knitting has ended or not.

If it has not, the method returns to the beginning of step 4 for measuring the distance between needles of the same color on a same row.

If instead the row of knitting has ended, the method moves on to step 7, which performs an advancement by a number of rows equal to the number of drops that are active on the circular knitting machine. This is followed by a step 8, which checks whether the pattern has ended or not.

If the response is negative, the method returns to the beginning of step 4; otherwise, if the response is positive, the step 9 checks whether the pattern has been modified or not.

If the pattern has been modified, the method returns to the beginning of step 3; otherwise the method continues to step 12 for encoding the pattern and therefore performing said pattern.

If the distance measured in step 5 is not equal to, or greater than, the minimum distance that allows to perform trimming, the method according to the invention provides for the execution of a step 10, in which additional special colors are added automatically, replacing them in some portions of pattern with the colors that are present.

In this case, as described earlier, the special colors correspond to a particular type of knitting on the circular knitting machine, and therefore replacement occurs when the distance between the special color and the special color on the same row of the pattern is shorter than the minimum distance that is sufficient to allow the machine to trim the thread.

The modification occurs only in a horizontal direction. Therefore, each added special color is matched by an interpretation that physically allows, in the machine, to have the space sufficient for trimming the loose thread that constitutes the pattern. Some methods provide for a change of type of knitting between one drop and the next, while others provide for the change of a thread guide on the same drop. The change of drop ensures the successful outcome of the trimming of the loose thread, while the thread guide change instead assumes that a given cylinder rotation rate is maintained in order to allow the thread guide to change.

When knitting for example at two drops on a four-drop machine, two active positions are available for each drop if the working method is for example 4-2, i.e., if the production drops are drops 4 and 2. This means that it is possible to insert two special colors in order to form the pattern. If the machine instead knits with drops 4 and 1 active, there are up to three drops for producing the pattern; this entails using three special colors to produce the pattern.

Substantially, the special colors that are inserted correspond to particular types of knitting that the machine is requested to perform in order to achieve a measurement of distance between needles of the same color on the same row equal at least to the minimum distance prescribed in order to be able to perform the loose thread trimming operation.

Step 10 for replacing the special color segment with a new special color is followed by a step 11 for modifying the initial pattern; this is followed again by the step 6 described earlier. The algorithm, in this case, then proceeds to step 12 for encoding the pattern as described earlier in the case in which the minimum distance for performing trimming was already initially present and was therefore verified in step 5.

In this way, the method automatically corrects said pattern so that the loose threads are trimmed so that they do not leave loops on the reverse side of the manufactured fabric. Coloring occurs automatically inside the programming environment of the machine and depends on the type of machine and on its mechanical and knitting characteristics as well as on the configuration that the user wishes to make it assume in the various selected knitting processes. In practice it has been found that the method according to the present invention fully achieves the intended aim and objects, since it allows to automatically correct a preset initial pattern so as to be able to trim the loose threads even if, according to the preset pattern, the conditions for performing trimming do not occur, without forcing the operator to perform a direct manual intervention.

The method thus conceived is susceptible of numerous modifications and variations, all of which are within the scope of the appended claims; all the details may further be replaced with other technically equivalent elements.

The disclosures in Italian Patent Application No. MI2003A000891 from which this application claims priority are incorporated herein by reference.

What is claimed is:

1. A method for trimming loose threads in circular knitting machines, wherein it comprises the steps of:

starting from an initial pattern and on the basis of a given type of circular knitting machine, if one wishes to trim the loose threads, measuring a distance between needles of the same color on a same row in order to check whether said distance is at least equal to, or greater than, a minimum distance that allows to perform trimming of the loose threads;

if said distance is shorter than said minimum distance, replacing a portion of said pattern with at least one special color that identifies a different type of knitting process for said portion of said pattern, to be performed on said circular knitting machine;

modifying said pattern on the basis of said replacement of said portion of said pattern;

producing an advancement by a number of rows equal to the number of drops of the knitting machine that are active; and encoding the pattern with the modifications, in order to perform the knitting process.

2. The method according to claim 1, wherein said step of replacing a portion of said pattern with a special color that corresponds to a given type of knitting process consists in actuating a change of drop for said textile machine or a change of thread guide.

3. The method according to claim 1, wherein said step of modifying said pattern is followed by a step which checks whether the row of knitting has been completed or not.

4. The method according to claim 3, wherein if said row of knitting has not been completed, the method returns to the step of measuring the distance between needles of the same color on a same row, in order to check whether said measured distance is equal to, or greater than, the minimum distance allowed for trimming said loose threads.

5. The method according to claim 1, wherein each special color corresponds to a given type of knitting process for said circular knitting machine.

* * * * *